US005786834A

United States Patent [19]

Carlotta et al.

[11] Patent Number: 5,786,834

[45] Date of Patent: Jul. 28, 1998

[54] METHOD AND APPARATUS FOR STORING AND SUPPLYING INK TO A THERMAL INK-JET PRINTER

[75] Inventors: Michael Carlotta, Sodus; Steven J. Dietl, Ontario; David P. Breemes, Sr., Palmyra, all of N.Y.

[73] Assignee: Xerox Corporation, Stamford, Conn.

[21] Appl. No.: 176,976

[22] Filed: Jan. 3, 1994

[51] Int. Cl.[6] ..... B41J 2/175

[52] U.S. Cl. ..... 347/87

[58] Field of Search ..... 347/85–87, 86, 347/93; 29/451

[56] References Cited

U.S. PATENT DOCUMENTS

| | | | |
|---|---|---|---|
| 4,095,237 | 6/1978 | Amberntsson et al. | 346/140 |
| 4,237,240 | 12/1980 | Jarre et al. | 521/159 |
| 4,306,245 | 12/1981 | Kasugayama et al. | 347/87 |
| 4,463,359 | 7/1984 | Ayata et al. | 346/1.1 |
| 4,771,295 | 9/1988 | Baker et al. | 346/1.1 |
| 4,824,487 | 4/1989 | Heffernan | 134/10 |
| 4,929,969 | 5/1990 | Morris | 346/140 |
| 5,233,369 | 8/1993 | Carlotta et al. | 347/87 |
| 5,289,212 | 2/1994 | Carlotta | 347/87 |
| 5,319,841 | 6/1994 | Yata et al. | 29/451 |

FOREIGN PATENT DOCUMENTS

| | | | |
|---|---|---|---|
| 466142A3 | 1/1992 | European Pat. Off. . | |
| 520695A3 | 12/1992 | European Pat. Off. . | |
| 536980A2 | 4/1993 | European Pat. Off. . | |
| 562733 | 9/1993 | European Pat. Off. | 347/87 |
| 571151A3 | 11/1993 | European Pat. Off. . | |

OTHER PUBLICATIONS

Dale R. Ims, et al., "Method of Operation of Ink Jet Printer", *Xerox Disclosure Journal*, vol. 16, No. 4, Jul./Aug. 1991, p. 233.

Baker et al., "Design and Development of a Color Thermal Inkjet Print Cartridge", Aug. 88, pp. 6–15.

*Primary Examiner*—N. Le
*Attorney, Agent, or Firm*—Tallam I. Nguti

[57] ABSTRACT

A method an apparatus for storing and supplying liquid ink to a thermal ink-jet printer includes a printhead that has ink ejection nozzles and an ink supply housing connected to the printhead. The ink supply housing defines an ink storage chamber, and an ink flow path communicating with the printhead and ink storage chamber. An ink storage medium and a scavenger member are placed in the ink storage chamber for retaining, and controllably supplying a quantity of liquid ink from the chamber within a desirable back pressure range at the printhead. The ink storage medium is a medium density non-reticulation process produced copolymer polyurethane foam consisting essentially of a blend of polyether and polyester materials.

12 Claims, 6 Drawing Sheets

METHOD AND APPARATUS FOR STORING AND SUPPLYING INK TO A THERMAL INK-JET PRINTER

FIELD OF THE INVENTION

The present invention relates to ink jet printing, and more particularly to a method and apparatus for storing and supplying liquid ink to a printhead in an inkjet printer.

BACKGROUND OF THE INVENTION

Existing thermal ink jet printers each include a print cartridge that comprises a printhead having one or more ink filled channels, such as disclosed in U.S. Pat. No. 4,463,359, and an ink supply unit attached to the printhead. Typically, ink in the ink supply unit is fed by capillary action to the printhead. The printhead channels are each arranged to communicate at one end thereof with an ink chamber of the ink supply unit, and with an ink ejection opening or nozzle at the opposite end of the printhead. A thermal energy generator, usually a resistor, is located in each of the channels, at a predetermined distance from the nozzle. Each resistor is electrically connectable to an electrical controller of the printer, and can thus be individually addressed or actuated with a current pulse in order to momentarily vaporize ink in a respective channel. Vaporizing the ink as such causes a vapor bubble to form in the channel and to then expand, expelling a droplet of ink through the respective nozzle. Acceleration of the ink out of the nozzle while the bubble is expanding ordinarily provides momentum and velocity to the droplet causing it to move in a substantially straight line direction towards a recording medium that is supported proximate the nozzles. Because the droplet of ink is emitted only when the resistor is actuated, this general type of thermal ink-jet printing is known as "drop-on-demand" printing.

In current practical embodiments of drop-on-demand thermal ink-jet printers, it has been found that the printers work most effectively when the pressure of the ink in the printhead nozzle is kept within a predetermined range of gauge pressures. Specifically, at those times during operation in which an individual nozzle or nozzles of an entire printhead are not actively emitting droplets of ink, it is important that a certain negative pressure, or "back pressure," exist in each of the nozzles and, by extension, within the ink supply unit of the printhead. A discussion of desirable ranges for back pressure in thermal ink-jet printing is given in the "Xerox Disclosure Journal," Vol. 16, No. 4, July/August 1991, p. 233. This back pressure is important for practical applications in order to prevent unintended leakage, or "weeping," of liquid ink out of the nozzles and onto the surface of the recording medium. Such weeping is, of course, undesirable because it will obviously have adverse results on copy quality.

A typical end-user product in this art is a print cartridge in the form of a prepackaged, usually a single disposable item comprising the printhead and ink supply unit. Generally, the print cartridge includes electronic parts for interfacing with the electrical controller of the printer. In particular, the electronic parts in the cartridge itself are associated with the ink channels in the printhead, and, for example, include resistors, temperature sensors, and digital means for converting incoming signals for imagewise operation of the resistive heaters.

In one common design of a thermal ink jet printer, the print cartridge is held with the printhead against the recording medium or sheet on which an image is to be printed, and is then moved across the sheet periodically, in swaths, in order to form the image, much like a typewriter. In a second type of ink jet printer, the print cartridge is full-width with respect to the sheet, and includes a full-width linear array of channels and nozzles. In this type of printer, the sheet instead is moved past the linear array of nozzles. In either case, print cartridges typically are purchased on an as needed basis by the consumer, and are used either until the supply of ink therein is exhausted, or, equally if not more importantly, until the amount of ink in the cartridge becomes insufficient to maintain the back pressure of ink therein within the useful range.

In order to consistently produce high quality printing, capillary ink feeding to the printhead from the ink supply unit of a print cartridge must be high and consistent. In addition, the back pressure for ink remaining in the ink supply unit of the print cartridge must be maintained within a desirable range for as long as possible while there is still a usable supply of ink in the supply unit. Therefore, a print cartridge must be designed so that it maintains ink back pressure within the desirable range for as large a proportion as possible of the total range of ink levels in its ink supply unit. As pointed out above, failure to maintain ink back pressure as such, will cause the ink remaining in the cartridge to undesirably leak out or "weep" through the nozzles of the printhead.

As disclosed for example in U.S. Pat. No. 4,095,237, U.S. Pat. No. 4,771,295, U.S. Pat. No. 4,929,969 (to be discussed below), and in pending U.S. patent application Ser. No. 07/634,585 which is assigned to the present assignee, it is known to use a scavenger unit as well as any particular number of specified foams, respectively, as capillary force generating, and back pressure producing, media for ink being handled in the print cartridge.

U.S. Pat. No. 4,095,237, for example, discloses an apparatus for supplying ink to a movable printhead. The apparatus includes a reservoir of liquid ink and foam rubber or foam plastic as the ink storage medium. The printhead is mounted a raised position relative to, and in communication with, the reservoir of liquid ink.

In U.S. Pat. No. 4,771,295 an ink storage and feed construction is disclosed, and includes a reticulated polyurethane ink storage foam for providing desired capillary feed, and back pressure. The disclosed foam in addition has a controlled capillarity, and a controlled porosity of 60–75 pores per inch. The foam is compressed in order to reduce the pore size therein and the foam thickness. Reducing the foam thickness increases its density as well as the capillary force produced by the foam. The production of reticulated foam materials ordinarily requires subjecting the foam materials to a reticulation process in which pores are burned through closed foam cell membranes. Foam material reticulated in this manner has the disadvantages of being relatively more expensive because of the additional reticulation process, and of containing burned-out membrane particles which must be removed by cleaning in order to prevent or risk ink contamination.

U.S. Pat. No. 4,929,969 discloses an ink jet printing method that includes an ink storage and feeding system using a reticulated polyurethane foam of a thermoset melamine-formaldehyde condensate that is claimed to have a uniform pore structure. This foam material comprises a three dimensionally branched network of fine filaments creating interstitial pores of uniform size. In addition to the disadvantages of reticulation-processed foam materials (as above), melamine type foam materials have relatively brittle cell structures. When dry, melamine therefore tends to undesirably produce significant amounts of melamine dust particles which become trapped in ink flow passages within a print cartridge. Some of the particles even end up inside the printhead portion of the cartridge where they are likely to cause print quality defects. In addition, melamine tends to dissolve in certain inks at elevated temperatures.

In pending U.S. patent application Ser. No. 07/634,585 assigned to the present assignee, a print cartridge is disclosed in which the ink-supply unit includes an ink storage chamber packed with a needled felt foam of polyester fibers that has desirable ink absorbency and ink release characteristics. A capillary foam member may be disposed along the ink supply line to the printhead, and has a capillarity greater than that of the foam in the ink storage chamber.

There is, therefore, a need for print cartridge that includes a clean ink handling foam material, and that is relatively low cost to produce. In particular, there is a need for such a cartridge that includes a non-reticulation processed foam material that has a high void volume as well as improved ink-absorbency characteristics. Such a foam material preferably should also have a reliable, non-brittle cell structure, improved ink-releasability characteristics, in addition to good capillary and back pressure force generating characteristics.

SUMMARY OF THE INVENTION

In accordance with one aspect of the present invention, apparatus for storing and supplying liquid ink to a thermal ink-jet printer comprises a printhead including ink ejection nozzles, a housing connected to the printhead and defining an ink storage chamber and an ink flow path that communicates with the printhead and ink storage chamber. An ink storage medium occupies at least a portion of the ink storage chamber, and is adapted to retain a quantity of liquid ink. The ink storage medium comprises a non-reticulation processed copolymer polyurethane foam that consists essentially of a blend of polyether and polyester materials.

According to another aspect, the method of the present invention includes the steps of attaching to a printhead having an ink inflow channel and an output nozzle, an ink housing defining a liquid ink chamber and an ink outflow opening from the chamber. The method also includes the steps of adding a quantity of liquid ink to the liquid ink storage chamber, and of inserting into the liquid ink storage chamber a quantity of a copolymer polyurethane foam consisting essentially of a blend of polyether and polyester materials for providing a desired ink-flow control over the feeding of ink from the ink supply unit to the printhead.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
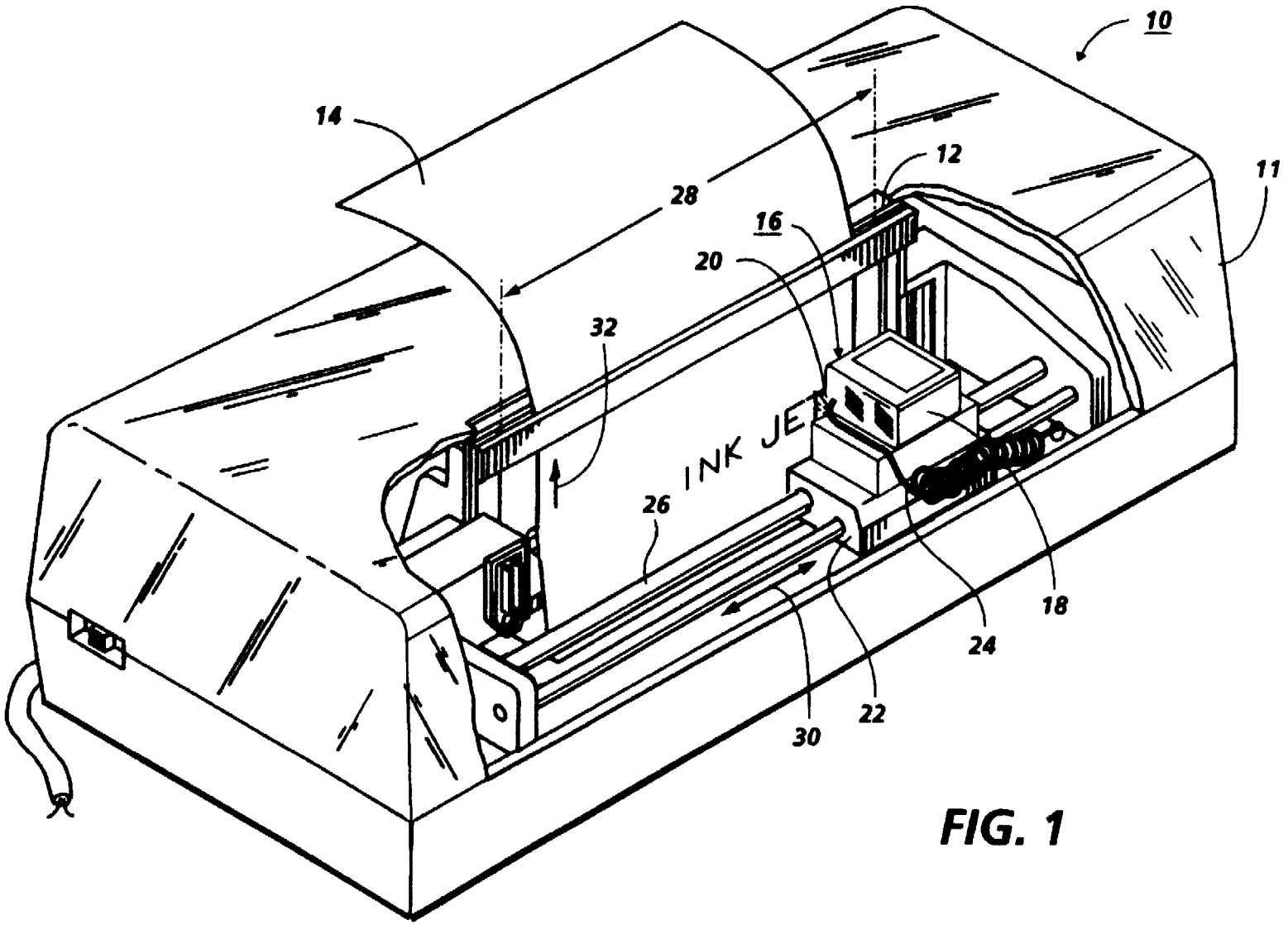
FIG. 1 is an isometric view of a thermal ink jet printer including a print cartridge according to the present invention.

Referring now to FIG. 1, a thermal ink jet printer is shown generally as 10, and includes a frame 11, means 12 for supporting a recording medium 14 (such as a sheet of paper), and a print cartridge 16. The print cartridge 16 as will be described below includes a printing ink supply unit 18 that is sealed to a printhead 20.

As shown, the print cartridge 16 is removably mounted on a carriage 22 and powered through means 24 for translation back and forth on a guide rail 26, and within a printing zone 28, as indicated by the arrow 30. During each such translation in a direction of the arrow 30, the recording medium or sheet 14 is stationary in order to allow the print cartridge to print a swath of information thereon. At the end of each directional translation, the recording medium or sheet 14 is stepped in the direction shown by the arrow 32 and for a distance equal to the height of a swath of information being printed.

Figure 2A:
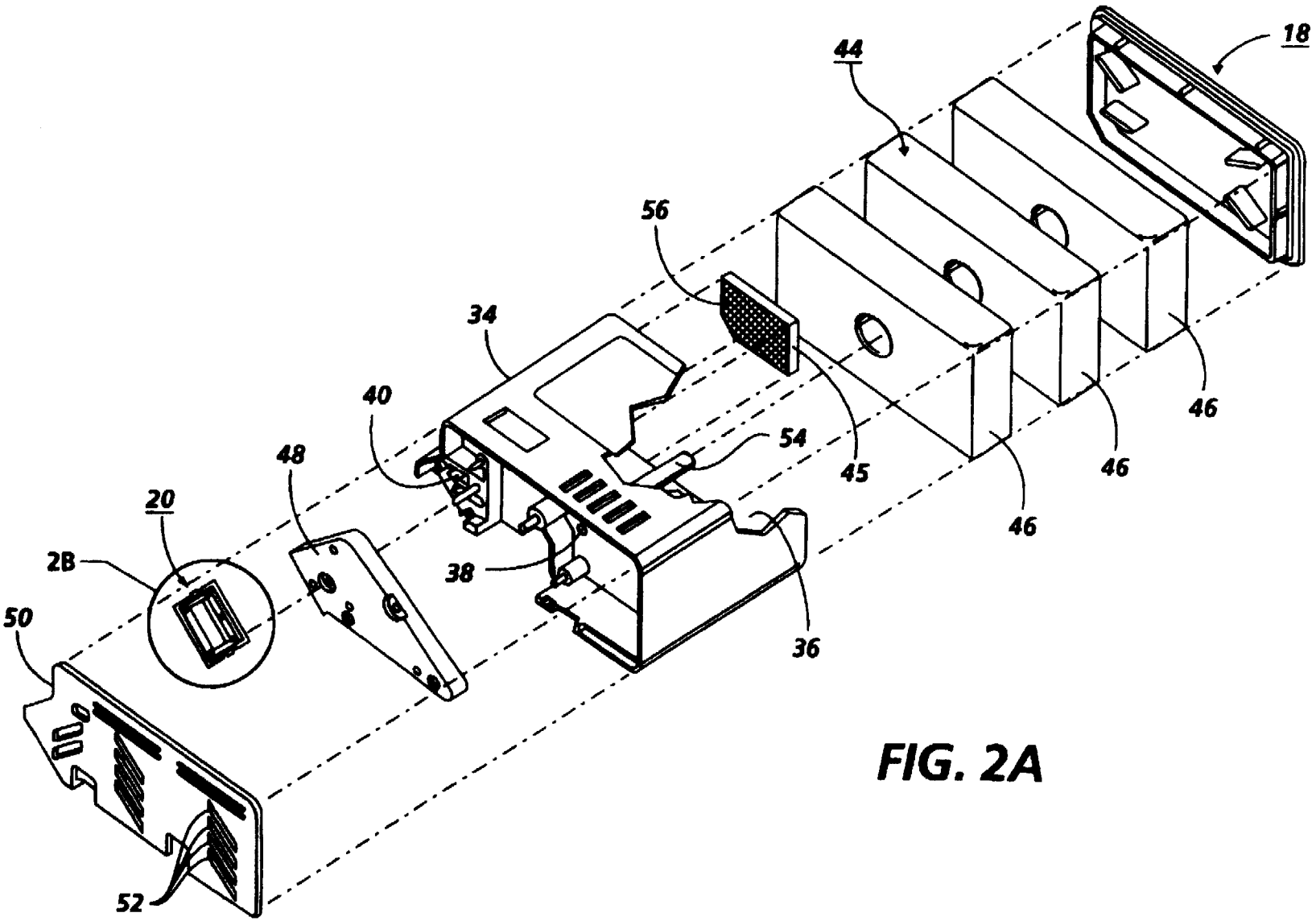
FIG. 2A is an exploded view of the print cartridge of FIG. 1 including a printhead.
Figure 2B:
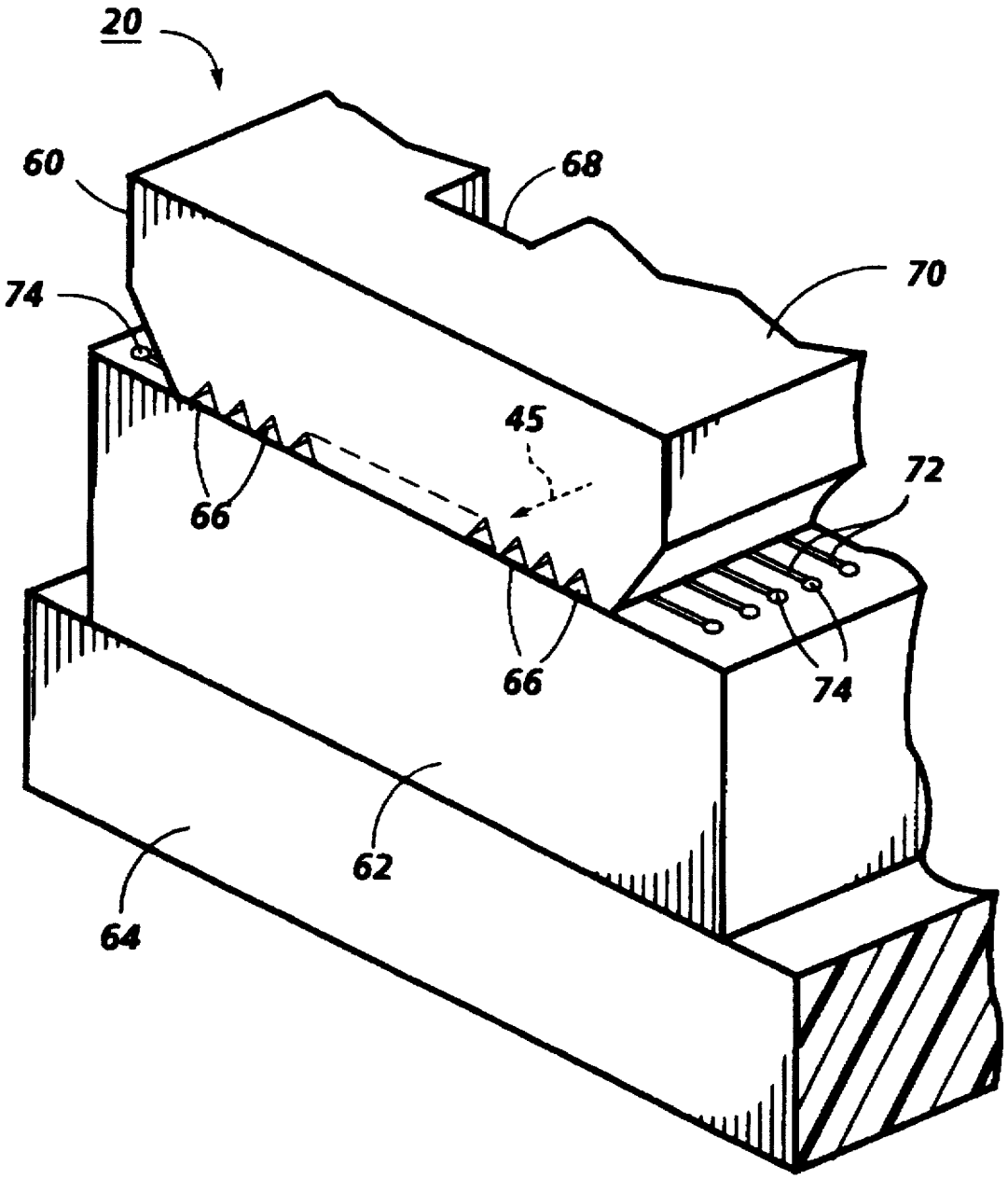
FIG. 2B is a partially shown enlarged isometric view of of the printhead of FIG. 2A.
Figure 3:
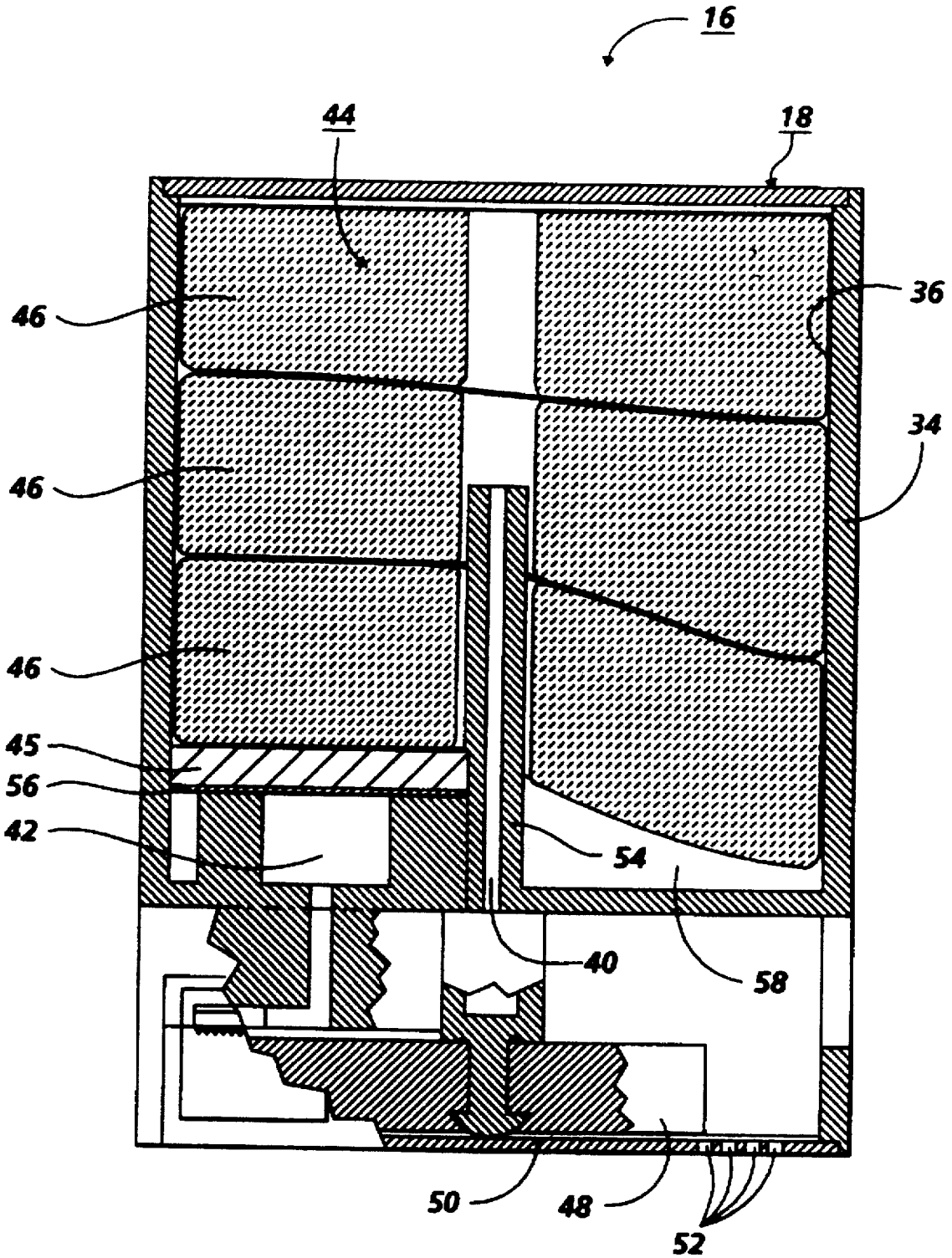
FIG. 3 is a sectional, elevational view of the print cartridge of FIG. 2A showing the foam material of the present invention.

Referring now to FIGS. 2A, 2B and 3, an exploded view of the print cartridge 16 is shown in FIG. 2A and illustrates, in particular, how various elements of the cartridge 16 may be assembled into a compact customer-replaceable unit. FIG. 2B is an enlarged isometric view of the printhead 20 of FIG. 2A, and FIG. 3 is a sectional, elevational view of the print cartridge 16. As shown, print cartridge 16 includes the ink supply unit 18 which has a main portion in the form of a housing 34 that typically is made of a lightweight but durable plastic material. Housing 34 of supply unit 18 defines a chamber 36 for the storage of liquid ink, a ventilation port 38 that is open to the atmosphere, and an ink output port 40 for supplying ink from the storage chamber 36. At the end of the output port 40 (as shown at the broken portion of FIG. 3) is the attached ink jet printhead 20, which includes an ink supply manifold 42.

As further shown, the print cartridge 16 of the present invention includes an ink handling foam material shown generally as 44 (to be described in detail below). The ink handling foam material 44 is used in the print cartridge 16, for example, as a scavenger member 45 for generating an ink feeding capillary force, and/or as an ink storage medium 46 that is packed into the chamber 36 for producing desired back pressure for ink flowing out of the chamber 36. When used as a storage medium 46, the foam material 44 may be formed into a single large block, or into a plurality of smaller blocks, for example, as three separate blocks which are each shown as 46.

The printhead 20 which is attachable over the ink output port 40 of ink supply unit 18 is shown more clearly in FIG. 2B. As shown, the printhead 20 includes first and second substrates 60, 62, respectively, that are bonded together and mounted on a motherboard 64. The first and second substrates 60, 62, as bonded, define ink output nozzles 66 which are in communication (through ink channels not shown) with an ink inflow opening 68. The surface of the printhead shown as 70 through which the ink inflow opening 68 is formed is the surface that is attached to the ink supply unit 18. As is well known, thermal electrodes 72 having electrically connectable terminals 74, are formed on the second substrate 62 such that a heating element (not shown) of each electrode 72 lies within an ink channel of the printhead 20.

Other parts of the cartridge 16 which are useful in a practical embodiment of the invention may include a heat sink 48 and a cover 50 that has openings 52 therethrough for also ventilating the interior of housing 34. The print cartridge 16 typically includes on-board circuitry means for connecting to, and for selectively activating the heating elements of the printhead 20.

As also shown in FIGS. 2A and 3, a tube 54 for additional interior ventilation may be provided in the ink supply unit 18 and such that it extends through openings in each block of the storage medium 46, from ventilation port 38 and toward the center of the interior of housing 34.

In the preferred embodiment of the present invention, the ink handling foam material 44 is a non-reticulation processed co-polymer polyurethane foam consisting essentially of a particular blend of polyether and polyester materials. As such, the foam material 44 is relatively less expensive to produce, and includes no burned out membrane particles to be removed therefrom. It is manufactured with water-based silicone foaming surfactants which are water removable, thus allowing for a freon-free detergent water washing process. It has a high void volume of approximately 80%. It is highly hydrophilic, exhibiting a high ink absorbency characteristic, yet it also exhibits a high ink releasability characteristic.

An example of the foam material 44 is available under the brand name ULTRA-SORB, from (foam converter) Wilshire Technologies Inc. of Carson Calif. It is made by (foamer) Time Release Science Company of Niagara Falls N.Y. More importantly, a specific blend of the ULTRA-SORB non-reticulated processed foam material 44, which is available as ULTRA-SORB MD (medium density), or ULTRA-SORB 312, has been found to be particularly effective as the ink storage medium 46. Its advantages include its ability to produce ink back pressures within desired ranges and to maximize the quantity of ink that can be absorbed, as well as the quantity of ink that it releases in usage. The ULTRA-SORB MD or (312) material typically has irregular shaped and non-uniform size pores with sizes within the range of 50μ–350μ. It has a density within the range of 3.0 to 4.5 $lb/ft^3$, and preferably a density of 3.5 $lb/ft^3$. It has a stored ink delivery efficiency of 65–75%.

Of equal importance, another specific blend of the ULTRA-SORB non-reticulated processed foam material 44 is available as ULTRA-SORB HD (high density) or ULTRA-SORB 317. This particular blend has been found to be very effective as a capillary force generating scavenger member 45, in the ink handling process within a print cartridge. Such effectiveness is true regardless of the type of foam material that is used as the ink storage medium in chamber 36. The ULTRA-SORB HD or 317 material, similarly, has irregularly shaped, non-uniform size pores also within a range of 50μ to 350μ, and a density of about 6.5 $lb/ft^3$. As such, it exhibits a flow impedance of 0.1 to 0.2" $H_2O$/cc/min.

Figure 4A:
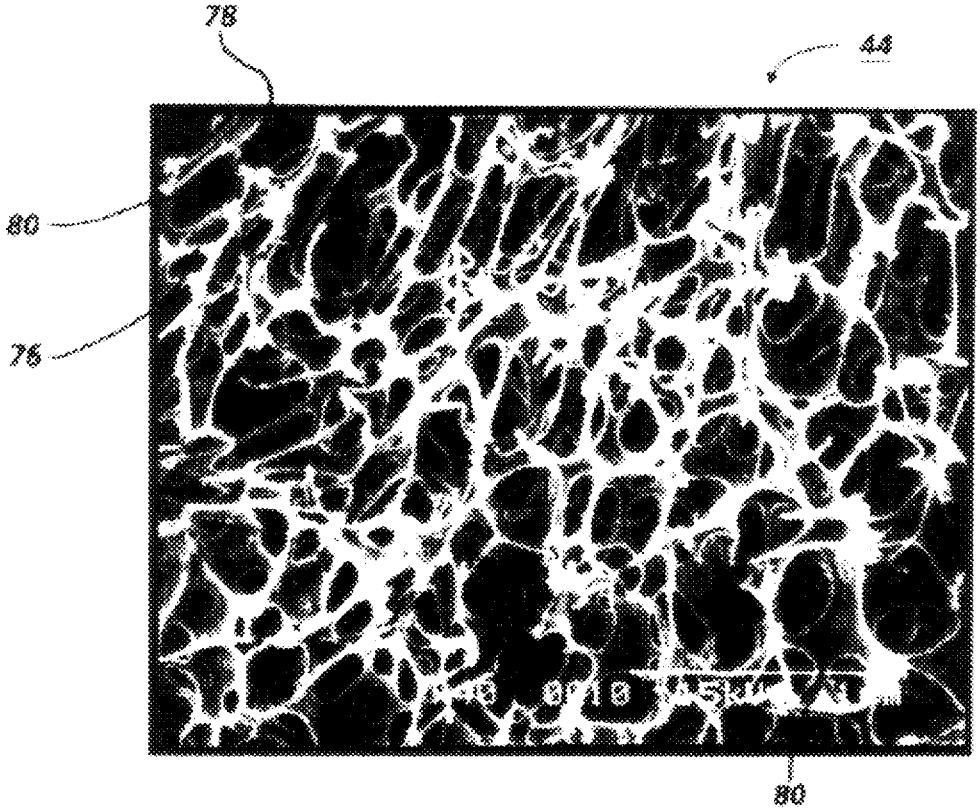
FIGS. 4A and 4B are enlarged views of a portion of the foam material of FIG. 3 showing its cell structure.
Figure 4B:
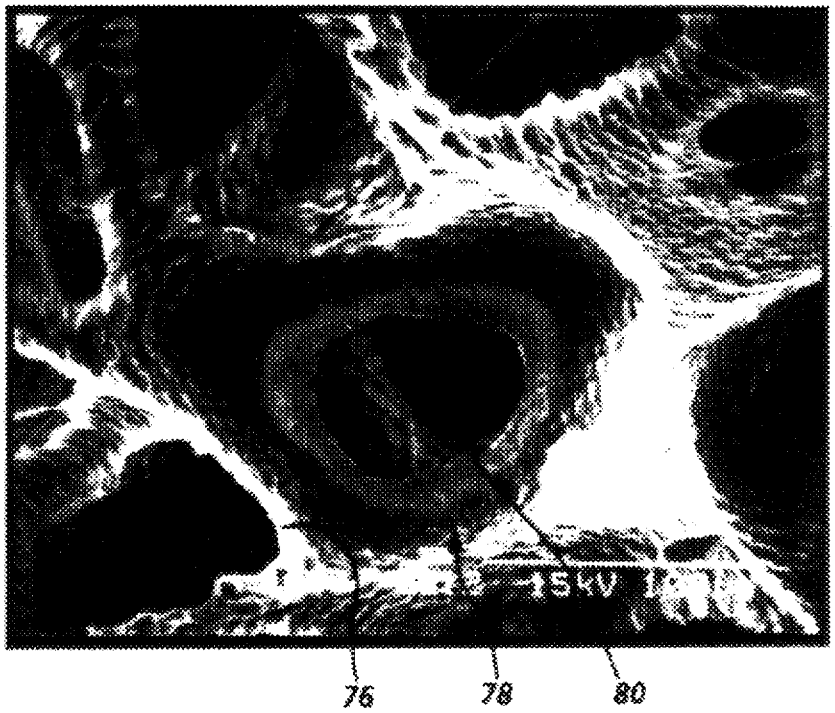

Referring to FIGS. 4A and 4B, the ULTRA-SORB ink handling foam material 44, in general, consists of web frames 76 which define cells 78. Each such cell 78 includes at least a non-reticulation process produced or virgin void or pore 80 therein (virgin meaning obtained directly from blowing). The web frames 76 are generally tri-lobal in cross-section, and are further structured and interconnected so as to form the voids or pores 80. Around each void or pore 80, one web frame 76 can coincide with web frames about three adjoining cells. As such, the cross-section of each web frame typically has three sides which, generally, are similar in size (much like the sides of an equilateral triangle). However, in some cases, two of the three sides can be substantially longer than the third side, thus creating a long thin web, as well as the irregular and apparently non-uniform voids or pores 80 throughout the foam structure.

By means of the voids or pores 80 the cells 78 intercommunicate fluidically throughout the foam structure. As stated above, each cell includes at least a non-reticulation process produced void or pore 80. In fact, some frames or cell walls may have several such openings linking one cell to another. Such openings as well as the individual cells themselves advantageously vary significantly in size from one to another. The advantages from such size variability lie in the fact that relatively smaller cells and smaller openings exhibit relatively higher capillarities than larger ones, and relatively larger cells and larger openings exhibit relatively lower capillarities than smaller ones.

In addition, the thickness of the web frames 76 forming the various cells 78 tends to vary significantly towards and away from each opening or pore 80 within the cell. The skin surface of each such web frame 76 is also irregular or uneven. Both latter characteristics as well as the cell and pore size variability, greatly contribute to the advantageous ability of the ULTRA-SORB material, in general, to absorb and hold a substantial quantity of liquid ink, as well as to release a large proportion of such a quantity of liquid ink effectively during printing with an ink jet print cartridge. In other words, the variations in cell size, cell wall void size, surface structure and material composition, all work together to produce the desired ink handling characteristics of the ink jet print cartridge 16.

Referring still to FIGS. 2A and 3, the ink storage medium 46 is packed inside the chamber 36 of housing 34 in such a manner that the foam material exerts reasonable contact and compression against the inner walls of the chamber. In one commercially-practical embodiment of the invention, the storage medium 46 is created by packing inside the housing 34, a single large block or three stacked layers (as shown) of the ULTRA-SORB MD (312) material.

As is well known in ink jet print cartridge manufacture, in addition to the foam storage medium 46 within the housing 34, a scavenger member 45 which is made of a suitable material for providing a high capillary pressure is also used. Such a scavenger member 45, preferably, is relatively thin, and serves as a porous capillary barrier between the storage medium 46 and the output port 40 which leads to the ink manifold 42 of printhead 20. However, it has been found that when the non-reticulation processed foam ULTRA-SORB MD (312) is used as the storage medium 46 within housing 34, a scavenger member 45 will ordinarily not be required. If however the storage medium 46 is not ULTRA-SORB MD (312), for example when it is a needled felt material, it is preferable that the scavenger member 45 be ULTRA-SORB HD (317).

An advantage of using ULTRA-SORB HD (317) as the scavenger member 45 is that it requires no "felting", that is to say it does not need to be compressed with heat and pressure in the direction of intended ink flow (as is the conventional practice) in order to ensure an enhanced capillary action. As shown, the scavenger member 45 ordinarily further includes a filter cloth, indicated as 56, which is attached to the scavenger member 45, using a porous hot-melt laminating adhesive for example. In general, the preferred material for the filter cloth 56 is a monofilament polyester screening fabric. Because the ULTRA-SORB foam material is produced without a reticulation process step, it is essentially waste-particle free, and either as a storage medium block 46, or a scavenger member 45, it ordinarily requires no filter cloth 56. For redundant protection of the printhead however, a filter cloth may be used.

The filter cloth 56, as such, provides a number of practical advantages. Typically, no specific structure (such as a wire mesh) for holding the scavenger member 45 against the opening into the ink output port 40 is necessary. Further, there need not be any adhesive between the filter cloth 56 and the output port 40. The high capillary force generated by the scavenger member 45 acts to create a film of ink between the filter cloth 56 and the ink output port 40, by virtue of the flatness (i.e. no wrinkles or bumps) of the filter cloth 56 against the scavenger member 45, as well as by virtue of the saturation and compression of the scavenger member 45 against the ink output port 40.

Referring still to FIG. 3, it can be seen that a portion of the outer surface of scavenger member 45 abuts the storage medium 46, while other portions of the surface thereof are exposed to an open space, indicated as 58, between the storage medium 46 and the inner walls of housing 34. The single chamber 36 of the housing 34 is so designed that a given quantity of ink may conceivably flow to or from the storage medium 46, and to or from the scavenger member 45. Alternatively, the ink may also flow to or from the free space 58 within the chamber 36 because there are no solid internal barriers to the flow of the ink within chamber 36. Generally, this arrangement of the storage medium 46, scavenger member 45 and filler cloth 56 within the chamber 36, serves to maintain the back pressure of the liquid ink within a manageable and desired range while the print cartridge 16 is slowly being emptied of liquid ink during printing.

Because ink transmittance through the storage medium 46 is not ordinarily rapid enough during printing to supply ink continuously to printhead 20, and because the storage medium 46, in addition, does not ordinarily provide the necessary seal for permitting continuous, air-free flow of ink through the output port 40, scavenger member 45 is intended to act as an ink capacitor, from which ink can be drawn even under conditions of a high rate of ink demand during printing.

In one commercially-practical embodiment of the present invention, the storage medium 46 is initially saturated with 65.2 cubic centimeters of liquid ink, of which it is desired to obtain at least 55 cubic centimeters for printing purposes while the back pressure of the cartridge is within a usable range 0.5 to 6.0" $H_2O$. A typical volume of the scavenger member 45 is 1.6 cubic centimeters. In printing a typical eight-inch swath in the course of printing a document, the scavenger member 45 may be desaturated by up to 2.5% of the ink therein in 0.5 seconds, and this desaturation will cause an increase in back pressure at the printhead 20. As desaturation causes an increase in back pressure with any absorbent medium, this back pressure will increase significantly in the course of printing a single swath of significant density across a sheet.

However, although desaturation of scavenger member 45 will cause an increase in back pressure at the printhead 20, this increased back pressure works in the other direction as well. That is, desaturation of scavenger member 45 will also cause a negative pressure against the storage medium 46, thereby causing a quantity of liquid ink to move from medium 46 to the scavenger member 45. Such flow of ink to the scavenger member resaturates it and results in a lowering of the back pressure it was causing. In this way, the combination of storage medium 46 and scavenger member 45 acts as a system for stabilizing the back pressure at printhead 20, as the supply of ink in ink chamber 36 is being used up during printing.

Figure 5A:
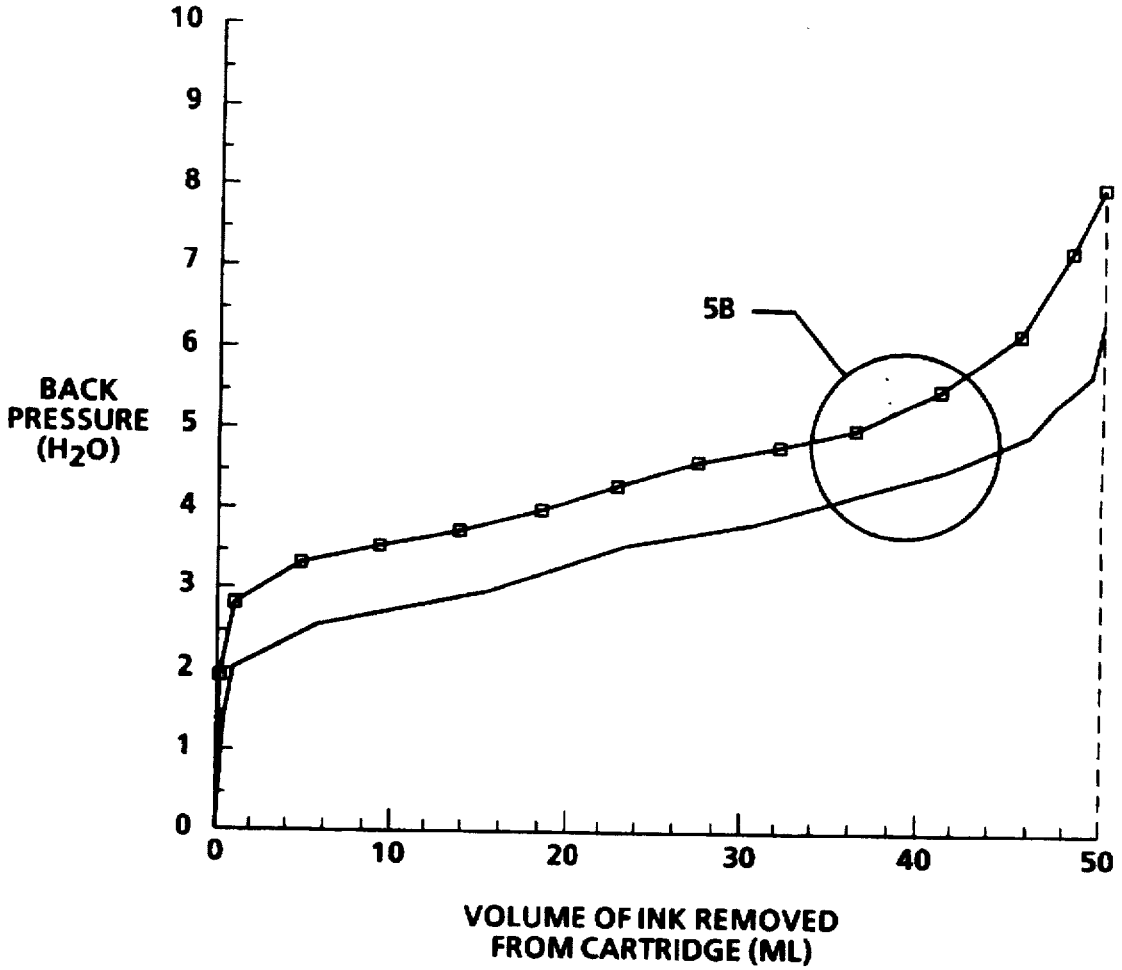
FIGS. 5A and 5B are graphs illustrating liquid ink back pressure of the print cartridge of the present invention as a function of the amount of liquid ink in the print cartridge.
Figure 5B:
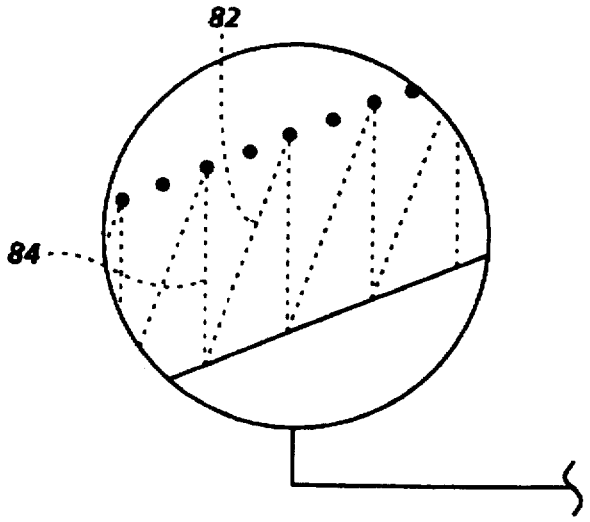

FIGS. 5A and 5B are graphs showing the performance of a print cartridge 16 that includes the non-reticulated processed co-polymer foam material 44 as a storage medium 46 according to the preferred embodiment of the present invention. As illustrated in the graphs, the back pressure which is maintained at the printhead 20 is kept within a usable and desired range for a great proportion of ink levels in the print cartridge 16. In FIG. 5A, the X-axis represents the volume of ink delivered from a 65.2 cubic centimeters ink capacity chamber 36 to and through the printhead 20 during printing. The Y-axis, on the other hand, represents the corresponding back pressure at the printhead 20 (in millimeters of water, where millimeters of water on the whole are comparable to millimeters of liquid ink). As can be seen clearly in FIG. 5A, the back pressure at the printhead 20 is maintained within a desired range of 0.5 to 6.0" $H_2O$ over which more than 55 cubic centimeters of ink have been delivered from the 65.2 cubic centimeters ink capacity chamber 36. Accordingly, only a reasonably small amount of ink is wasted due to excessive back pressure.

In the graph of FIG. 5A, two line plots are shown of which the solid line is the "static capillary pressure" at the printhead 20, and the dotted line above the solid line represents momentary back pressure spikes created at the printhead 20 in the course of its printing of individual swatches of information across a sheet, and at maximum printing density.

Referring to FIG. 5B, a detailed view of a portion of the graph of FIG. 5A is shown illustrating a typical back pressure behavior at the printhead 20 in the course of a continuous or substantially continuous printing operation. The finely-dotted lines, forming a sawtooth pattern with increasing portions 82 and decreasing portions 84, illustrate the actual continuous-time behavior of the back pressures between the solid line (static capillary back pressure) and the local maxima indicated generally by the larger dotted line visible in FIG. 5A. With each sawtooth, the momentary increases illustrated by the increasing portion 82 represent the increase in back pressure as the scavenger member 45 feeds ink to the printhead 20 in the course of printing a swath. On the other hand, the relatively quicker down portions 84 of each sawtooth represent the relatively rapid resaturation of the scavenger member 45 with ink from the storage medium 46, thereby desaturating medium 46. In addition to the desaturation of the medium 46, another source of back pressure in a print cartridge such as 16 is the "impedance" of ink flow through the various elements of the cartridge 16, caused, for example, by various shear forces within and among the storage medium 46 and scavenger member 45.

In this way, it can be seen that the structure and materials of the present invention provide not only the desired range of back pressures toward the printhead in a consistent manner over the life of the print cartridge, but also maintain a relatively consistent level of back pressure, even in the course of continuous use during printing operations.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A method for storing and supplying liquid ink to an ink jet printhead having an ink inflow channel, the method comprising the steps of:

(a) attaching, to the printhead, a housing defining a liquid ink storage chamber and an ink outflow opening such that said ink outflow opening of said housing is in communication with the ink inflow channel of the printhead;

(b) adding a quantity of liquid ink to said liquid ink storage chamber; and (c) placing into said liquid ink storage chamber a quantity of a non-reticulation processed copolymer polyurethane foam material having a bulk density of 3.5 lb/ft$^3$ for providing desired ink-flow back pressure and release efficiency over ink flowing from said storage chamber to the printhead, and having tri-lobal web frames defining cells including virgin or non-reticulation process produced open pores for controlling ink flow back pressure and ink releasability, said open pores ranging in size from 50μ to 350μ.

2. The method of claim 1, wherein said placing step includes placing a quantity of a first blend of non-reticulation processed copolymer polyurethane foam material having a first bulk density of 3.5 lb/ft$^3$ as an ink storage medium inside said chamber, and a second blend, having a second bulk density of 6.5 lb/ft$^3$ as a scavenger member between said ink inflow channel of the printhead and the storage medium.

3. A drop-on-demand ink jet printer comprising:

(a) first support means for supporting a recording medium within a printing zone;

(b) second support means for supporting a print cartridge in printing relation to said recording medium; and (c) a print cartridge supported on said second support means spaced from said recording medium, said print cartridge comprising a printhead, and an ink supply unit defining a liquid ink storage chamber, a quantity of liquid ink in said chamber, and a quantity of a non-reticulation processed co-polymer polyurethane foam material having a bulk density of 3.5 lb/ft$^3$ and consisting essentially of a blend of polyether and polyester materials packed into said chamber, said non-reticulation processed foam material having tri-lobal web frames defining cells including virgin or non-reticulation process produced open pores for controlling ink flow back pressure and ink releasability, said open pores ranging in size from 50μ to 350μ for producing a desired capillary force for ink flow into said printhead, as well as a desired ink-flow back pressure at said printhead.

4. The ink jet printer of claim 3, wherein said copolymer polyurethane foam material comprises a pattern of non-uniform non-reticulation process produced pores located in cells defined by a system of web-like frames.

5. The ink jet printer of claim 4, wherein said cells defined by said system of web-like frames vary in size from one to another.

6. The ink jet printer of claim 4, wherein said copolymer polyurethane foam material is hydrophilic.

7. The ink jet printer of claim 4, wherein some of said cells defined by said system of web-like frames each include a plurality of said pores.

8. The ink jet printer of claim 4, wherein said web-like frames of said copolymer polyurethane foam material vary in thickness towards and away from said pores.

9. The ink jet printer of claim 4, wherein said web-like frames each have uneven surfaces.

10. The ink jet printer of claim 4, wherein said foam material was made using water-based silicone foaming surfactants.

11. An ink supply unit for attaching to an ink jet printhead, the ink supply unit comprising:

(a) a housing defining an ink outlet opening, and a liquid ink storage chamber for containing liquid ink;

(b) a quantity of liquid ink in said storage chamber; and (c) a quantity of a non-recirculation processed co-polymer polyurethane foam material packed as a storage medium into said storage chamber for producing a desired back pressure for ink flowing out of said ink outlet opening to the printhead, said co-polymer polyurethane foam material having a bulk density of 3.5 lb/ft$^3$ and consisting essentially of a blend of polyether and polyester materials, having tri-lobal web frames defining cells including virgin or non-reticulation process produced open pores having pore sizes within a range of 50μ–350μ.

12. The ink supply unit of claim 11, wherein said web frames of said blend of polyether and polyester materials each have a thickness varying towards and away from each of said virgin or non-reticulation process produced open pores.

* * * * *